United States Patent [19]

Leibee et al.

[11] Patent Number: 4,662,759

[45] Date of Patent: May 5, 1987

[54] PREMIX INJECTION SYSTEM FOR ASPHALT COMPOSITIONS

[75] Inventors: Bruce K. Leibee, Wilmington, Del.; James P. Modrak, Conyers, Ga.

[73] Assignee: Hercules Incorporated, Wilmington, Del.

[21] Appl. No.: 810,612

[22] Filed: Dec. 19, 1985

[51] Int. Cl.[4] ..... B28C 5/00; B01F 15/02

[52] U.S. Cl. ..... 366/2; 366/11; 366/165; 366/174; 366/178

[58] Field of Search ..... 366/2, 3, 5, 10, 11, 366/165, 178, 174; 406/57, 80; 198/664; 222/238

[56] References Cited

U.S. PATENT DOCUMENTS

| | | | |
|---|---|---|---|
| 1,374,232 | 4/1921 | Reed . | |
| 2,394,058 | 2/1946 | Hitchcock et al. | 406/57 |
| 2,405,695 | 8/1946 | Hitchcock et al. | 302/37 |
| 2,464,973 | 3/1949 | Freiden | 406/80 |
| 2,496,146 | 1/1950 | Boughman | 302/50 |
| 2,575,639 | 11/1951 | Scranton et al. | 222/238 X |
| 2,644,723 | 7/1953 | Johnston | 302/37 |
| 2,721,147 | 10/1955 | Sullivan | 366/5 X |
| 3,145,063 | 8/1964 | Kools | 302/37 |
| 3,302,978 | 2/1967 | Scarnato et al. | 302/37 |
| 3,466,095 | 9/1969 | Weihmuller | 302/37 |
| 3,697,230 | 10/1972 | Fugimoto et al. | 366/165 X |
| 3,705,710 | 12/1972 | Mueller | 259/151 |
| 3,791,630 | 2/1974 | Hinds, Jr. | 366/165 X |
| 4,175,873 | 11/1979 | Iwako et al. | 366/178 X |
| 4,184,771 | 1/1980 | Day | 366/10 X |
| 4,236,654 | 12/1980 | Mello | 222/238 |
| 4,344,580 | 8/1982 | Hoshall et al. | 198/664 |
| 4,445,832 | 6/1984 | Schumacher et al. | 366/174 X |
| 4,499,561 | 2/1985 | Mason et al. | 366/165 X |

*Primary Examiner*—H. Hampton Hunter

*Attorney, Agent, or Firm*—John E. Crowe

[57] ABSTRACT

An injection system for asphalt, asphalt-containing or other viscous compositions, comprising a mixing drum or receptacle, an injection device having a housing and mounted nozzle jet for preparation and discharge of a premix comprising such asphalt or other composition(s) admixed with staple fiber, means for supporting the injection device, and means for supplying composition and fiber components through the injection device in flowable condition, the composition flow pattern being arranged external and generally concentric to the fiber flow and in a downstream blocking flow pattern relative to the fiber flow to assure wetting and encapsulation thereof before discharge of the premix; and a method for introducing staple fiber and filler or other additives, as desired, into the asphalt composition by using the injection device.

20 Claims, 5 Drawing Figures

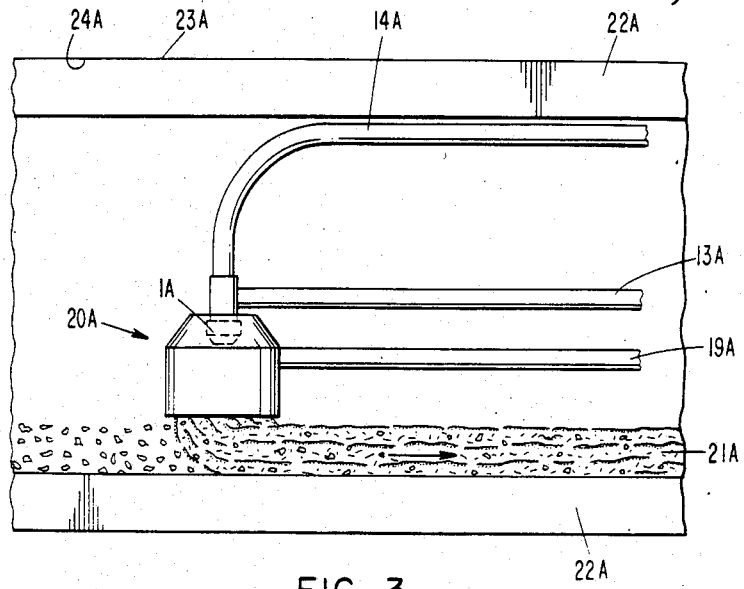
FIG. 3
FIG. 4
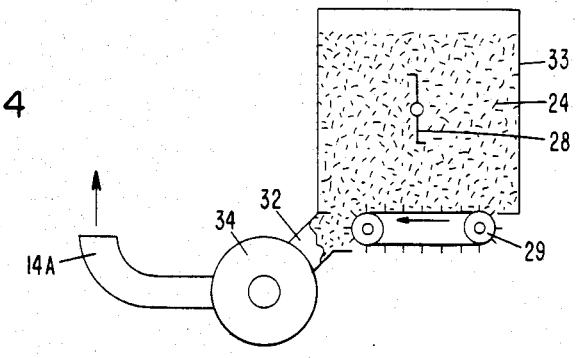
FIG. 5
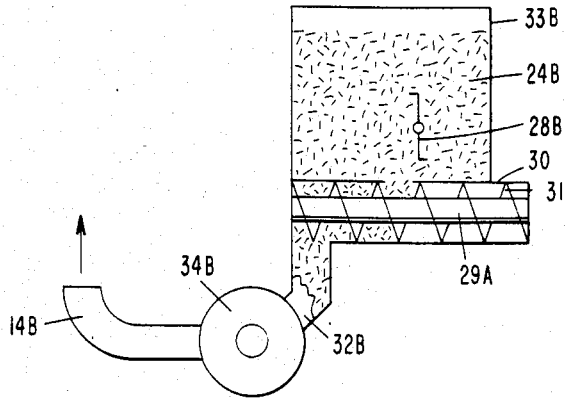

PREMIX INJECTION SYSTEM FOR ASPHALT COMPOSITIONS

The present invention relates generally to a system and parts thereof whereby staple fiber and other components, as desired, are evenly premixed with viscous material such as resin, asphalt- or asphalt-based compositions to permit initial controlled flow-encapsulation of the fiber with the viscous material.

BACKGROUND

By way of background, many miles of existing highways comprise asphalt-based materials in combination with various aggregates such as gravel, crushed stone, and sand. Numerous additional miles are built each year in which asphalt serves as the main component. The continued widespread use of such material, however, depends substantially upon cost, durability of the surface, and the frequency and nature of required preventative maintenance in response to constant weather and vehicular-induced damage. Fiber reinforcement and laydown procedures are very important with respect to such cost and durability factors.

For example, when repair or resurfacing of asphalt or asphalt-based road surface is carried out, hot fiber-containing liquified asphalt or asphalt fiber-reinforced emulsions are applied in one form or another as filler, as a waterproof underlayer between old and proposed new paving surfaces, and an external surfacing material. For each purpose, however, the amount and fineness of aggregate, the nature and amount of curing and thickening agents, and the concentration of reinforcing fiber and various other additives can vary widely, depending upon desired characteristics.

Because of the relative expense and the general importance of fiber reinforcement generally, and because of the difficulty in mixing light fiber components evenly into viscous compositions of the above type without clumping or clogging, and because of the substantial dependence of road paving applications on ambient temperature or weather, it is found useful to set up centrally located asphalt processing plants such as drum mixing plants, of a transient or mobile type which are capable of providing substantial amounts of various mixtures of asphalt with one or more of aggregate (including sand), reclaimed materials, fiber, filler such as curing agents, and recirculated bag fines, etc., under proper condition for delivery and lay down.

It is an object of the present invention to obtain an easily assembled device for efficiently preparing premix compositions comprising a viscous composition component and light weight reinforcing fiber component for introduction into a suitable receptacle.

It is a further object to reduce fiber and other fines loss and to minimize potential heat damage to fiber inherent in asphalt drum mix operations through use of an efficient premixing device.

THE INVENTION

The present invention addresses itself to the above objects, as a multi-purpose fiber injection system for injecting fiber into viscous compositions comprising (A) a receptacle such as a drum or other suitable retaining device inclusive of jet-heated rotatable mixing drums of the type used, for instance, for preparing or reprocessing asphalt-based surfacing, (B) an injection device as hereinafter described, comprising (1) an injection housing having a feeder nozzle part at one end and a housing discharge port at the opposite downstream end, (2) an injection nozzle mounted in said feeder nozzle port, said nozzle having an outer flow channel and an inner flow channel concentrically arranged, and having a common downstream discharge port externally defined by a truncated extension of the outer wall of said outer flow channel, the downstream end of said inner flow channel terminating within said nozzle at a point upstream of and spaced from said common discharge port, (3) an internal filler port in the injection housing externally arranged with respect to the nozzle for inserting additional components such as bag fines and filler material into the injection device and through the housing discharge port, as desired, (4) a breaker cone supportably secured to the injection housing and positioned downstream of said nozzle, the apex of said cone being directed at the common discharge port, (5) ducting and support means feedably secured to the nozzle for feeding fiber and viscous composition to the injection nozzle and supporting the injection device for discharging premix into the receptacle, and (C) metering and feeding means comprised of (a) means for separately supplying viscous composition such as hot asphalt, asphalt-based compositions, polymers and prepolymers; (b) fiber component(s) and additional components, as desired, in flowable condition respectively through the ducting and support means;

whereby viscous composition delivered through said ducting and support means from a feeding means, is directed inwardly and downstream by said truncated extension of said outer flow channel to form an essentially hollow cone-shaped flow pattern upstream of said breaker cone; and said fiber component delivered through said ducting and support means from said metering and feeding means through said inner flow channel, is directed downstream through said common discharge port to impinge upon the viscous composition forming an inside wall of said hollow cone-shaped flow pattern to wet and encapsulate the fiber component and impinging at least in part onto said breaker cone prior to discharge of the premix.

Utilizing the above-described system, it becomes possible to easily and uniformly introduce staple fiber and additives, as desired, into viscous compositions. Such include, for instance, resins, polymers, hot asphalt and various asphalt-based materials such as emulsions by feeding reinforcing staple fiber, preferably entrained in a vehicle such as air, inert gas, or aerosol, in combination with the composition component. As such they are introduced in separate, generally-concentric flow patterns within an injection device (as described herein), in which the viscous composition is externally arranged with respect to the fiber and extruded in the form of a hollow cone-shaped flow pattern, the internal surface of the cone-shaped flow pattern being contacted by the flow pattern of the fiber component. For such purpose the relative speed and angle of impingement of the two flow patterns is sufficient to maximize fiber contact with the internal surface of the cone-shaped flow pattern to wet and encapsulate the fiber.

The following drawings further illustrate embodiments of the system, the injection device, and method of the present invention.

BRIEF DESCRIPTION OF THE DRAWINGS

FIG. 3 is a schematic longitudinal section showing the injection device in discharge position within an axially rotatable receptacle such as a mixing drum.

FIGS. 4 and 5 are schematics showing suitable metering and feeding means for the fiber component.

DETAILED DESCRIPTION OF THE DRAWINGS

Figure 1:
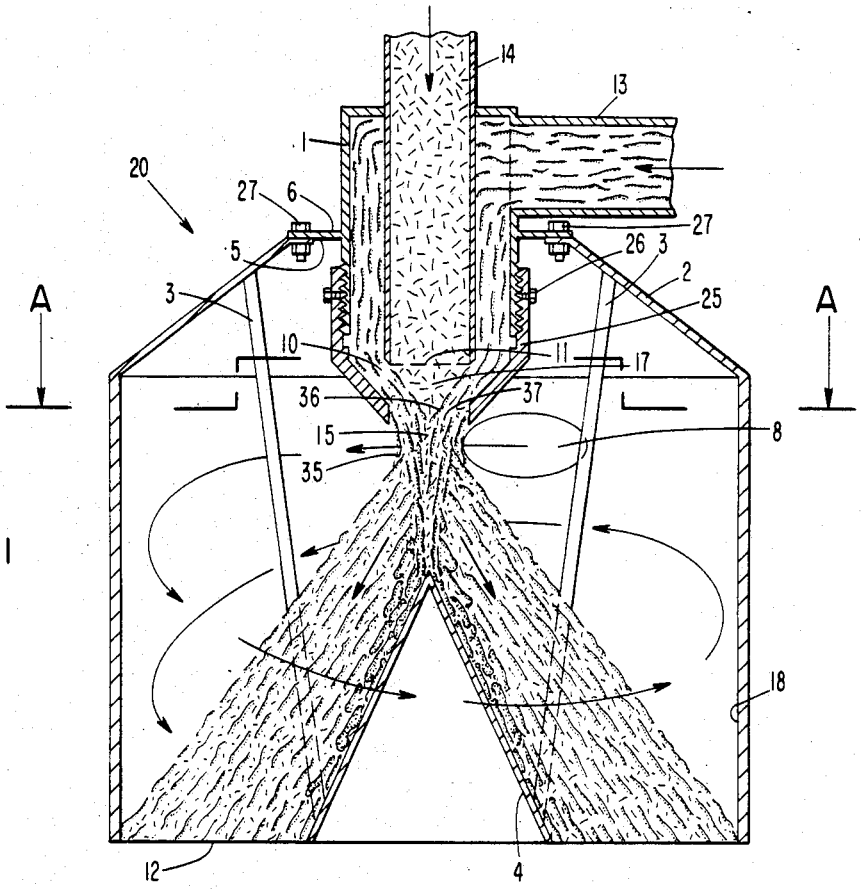
FIG. 1 is a longitudinal schematic section of an injection device within the scope of the present invention.

FIG. 1 comprises an injection device (20) having an injection housing (2) having a housing discharge port (12), a feeder nozzle port (5) in general opposition to the housing discharge port, and an internal filler port (8) laterally arranged with respect to flanged injection nozzle (1), the nozzle being mounted within feeder nozzle port (5), the downstream end of the external nozzle wall being extended with an internally threaded frustoconically shaped adjustable head (25) secured, in adjustment with lock screw (26), said injection nozzle being mounted within the feeder nozzle port by mounting flange (6) secured to injection housing (2) by bolts (27).

As shown, injection nozzle (1) produces a premix comprising (a0 viscous composition(s), inclusive of polymers, prepolymers, hot asphalt or asphalt-containing emulsions and (b) an amount of staple fiber sufficient to provide up to about 20 weight percent of encapsulated fiber component such as fiberglass, asbestos, synthetic polymeric staple fiber such as polyolefins and polyesters and carbon fiber, etc. For present purposes the viscous composition is supplied through external composition feed pipe (13) and outer flow channel (10) under pressure, and discharged through common discharge port (37) in the form of a hollow cone-shaped flow pattern (15) having an external face (35) and an internal face (36), said composition pattern being directed inwardly and downstream from common discharge port (37).

The fiber component, preferably a staple reinforcing fiber, as above listed, is conveniently entrained in a vehicle such as air, an inert gas, or an aerosol, and fed through fiber feed pipe (14) and down inner flow channel (11) and discharged in a downstream direction from common discharge port (11), the fiber source not being shown. The fiber feed pipe is arranged in partial internal concentric arrangement with respect to outer flow channel (10) and head (25) the later forming the downstream extension of asphalt composition feed pipe (13) which discharges through common discharge port (37) as a conical shaped fiber flow pattern (17), the fibers of which are blocked, wetted and encapsulated by the internal wall (35) composition of cone shaped composition flow pattern (15), declumped by strut (3)-supported breaker cone (4), and the resulting premix discharged through housing discharge port (12).

Internal filler port (8) is arranged for optional insertion of additional components into the injection device, preferably along a circular or cyclonic pathway generally above the external face of the fiber and composition flow pattern. Such inserted material can conveniently include, for instance, recirculating bag fines, filler material, and additives such as diatomaceous earth, sand, portland cement, lime, alum, etc. as desired. Filler port (8) and filler feed pipe (19) (see FIG. 2), as positioned, favor the preferred circular or cycloidal flow pattern as shown by the circulating arrows, however, such arrangement can be replaced with one or more slotted or circular ports aimed for insertion or at any point above the line of impact of the exterior composition flow pattern on the interior wall (18) of injection housing (2).

Figure 2:
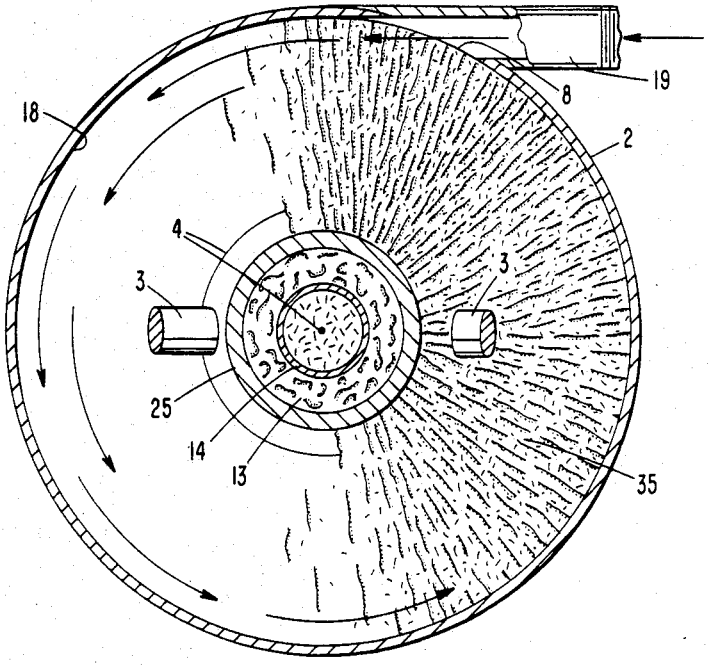
FIG. 2 is a downstream view in cross-section along line A—A of FIG. 1, showing part of threaded trumcated adjustable head (25) and filler feed pipe (19) feedably connected to internal filler port (8) on injection housing (2), with a broken away view of the external face (35) of a flow pattern comprising fiber and viscous composition as discharged from the injection nozzle.

In FIG. 2 the numbered components coincide with those shown in FIG. 1, except for tangentially attached filler feed pipe (19) described above.

FIG. 3 is a schematic longitudinal section demonstrating the positioning of injection device (20A) feedably mounted for discharge of premix within a mixing drum (23A) of the type used in asphalt drum mixing plants, the drum being rotated on its long axis, using a side-mounted track and friction wheel drive, a gear and sprocket, a circular rack and pinion, or similar known arrangement (not shown) which does not interfere with aggregate drying means such as end-mounted gas jets (not shown), aggregate feeding means (not shown), and means for discharging the resulting drum mix (not shown). As further aids for mixing purposes are shown mixing fins (22A) internally mounted on the inside face (24A) of the drum. Also shown are fiber feed pipe (14A), and composition (asphalt) feed pipe (13A) in feedable relation to injection nozzle (1A) (shown partly in phantom), and filler line (19A) in feedable relation to injection device (20A) through a housing-mounted internal filler port (not shown), to permit the above noted additives and recycled fines to be introduced to form a desired premix for discharge into the drum or receptacle.

Drum mix (21A), as shown, comprises of premix in downstream combination with separately-introduced hot dry aggregate (unnumbered).

When desired, the angle of the injection device can vary from about 0° to 60° from the vertical, depending upon the transverse velocity or flow of hot exhaust gas or other heat-transmitting vehicle used to dry the aggregate and maintain composition flowability in the drum.

FIGS. 4 and 5, as above noted, are schematic longitudinal sections demonstrating a part of a suitable metering and feeding means, whereby metered amounts of staple fiber entrained in air, are forced through fiber feed pipes (14, 14A or 14B) of the foregoing figures.

In FIGS. 4 and 5 are also shown fiber holding tanks (33, 33B) containing staple fiber (24, 24B) conveniently from about ⅛" up to about 4" in length or longer, which is conveniently broken up for feeding and metering purposes by the use of an automatic or manually actuated bridge breaker (28, 28B) and delivered with a cleated feed belt (29) or auger (29A) at a convenient desired rate to blower feed line (32, 32B) through blower (34, 34B) and through fiber feed pipe (14A, 14B) for introduction into injection devices (20, 20A) of FIGS. 1 and 3. Activating means such as belted electric motors or cranks, etc. for breaker (28) and feed belt (29) are not shown.

In FIGS. 4 and 5, an efficient feed rate is determined largely by blower (34, 34B) speed, belt (29) or auger (29A) speed, and the continuous efficient operation of bridge breaker (28, 28B).

For purposes of the present invention it is also found most convenient to regulate blower speed to obtain an air velocity range of about 3500–9000 ft./minute or even slightly higher to avoid clogging of fiber such as polyolefin fiber, although the rate may vary for other fibers and composition.

Using asphalt composition, by way of example, it is found convenient to liquify the composition by preheating or by emulsification, and pumping (pump not shown) the liquid through asphalt composition feed pipe (13) at a volumetric flow rate of about 20–150 gal./minute. Calculations with respect to the volume flow of asphalt composition are conveniently based on the formula Asphalt Velocity (ft/min)=(Volumetic Flow Rate/Annular Area).

For purpose of using the present invention, it is found that a ratio of vehicle (air) velosity-to-asphalt composition feed velocity (ft./minute) of about 1–35:1 and preferably about 3–6:1 is suitable for obtaining a standard (93/7) asphalt/fiber paving mix.

For purposes of efficient fiber distribution through encapsulation within a premix, it is also found advantageous, depending upon expected drum mix rate, to loosen lock screw (26) of FIG. 1 to permit rotational adjustment of adjustable head (25), to favor maximum impingement of fiber clumps on breaker cone (4) downstream of common discharge port (37), to assure adequate wetting of fiber and fines.

The injection device of the present invention can successfully premix various types of fiber, including nonstaples, with a number of viscous or semi-viscous liquids but the fiber component preferably has a dpf value of about 2–7,500 or higher and a staple length of about 0.20″–5.0″.

EXAMPLE 1

(A) An injection device having a 24″ housing (outside diameter) of the type described in FIG. 1 and provided with fiber delivery means consisting of a staple fiber-filled hopper having a manually operated bridge breaker, the hopper being feedably connected to a 2 horsepower Neuero Model BG80 blower having a maximum driven output of about 9,000 ft/minute, the fiber being metered and delivered to the blower by operation of a bottom-mounted 10 inch auger feed arrangement of the type and connected in the manner shown schematically in FIGS. 3 and 5.

Using 0.4 inch staple polypropylene fiber of 4 dpf and air as a vehicle, it is found that fiber flow rates of 20 and 40 lbs/minute and paving grade asphalt(*1) flow rates of 60 and 100 gallon/minute are successfully and efficiently premixed without plugging, provided a vehicular air velocity of not less than 3,500 ft/minute is maintained.

*1 AC 20 commercially available from Atlantic Richfield Company (B) The injection device of paragraph (A) is successfully used to admix an equal amount of 0.4″ staple polypropylene fiber into a commercial cationic slow set asphalt emulsion(*2) in place of the asphalt.

*2 Available commercially as CSS emulsion from West Bank Oil; and Windsor services of Reading, Pa., ASTM D 2397 specifications.

(C) The injection device and mechanical components of paragraph (A) are used successfully to introduce asphalt premix, into a 2,000 cubic foot rotating metal drum containing 40,000 pounds medium grade stone aggregate dried by an endmounted propane burner to a temperature of 600° F., the drum being rotated at 10 revolutions/minute to obtain 250 TPH tons of fiber-containing drum mix/hour in good lay down condition containing 6 lbs/ton of polypropylene fiber component at about 300° F.

What we claim is:

1. A multi purpose fiber injection system for injecting fiber into viscous composition, comprising, in combination (A) a receptacle;

(B) an injection device mounted for discharge of premix comprising viscous composition and fiber into said receptacle, the injection device comprising (1) an injection housing having a feeder nozzle port at one end and a housing discharge port at the opposite downstream end, (2) an injection nozzle mounted in said feeder nozzle port, said nozzle having an outer flow channel an inner flow channel concentrically arranged, and having a common downstream discharge port externally defined by a truncated extension of the outer wall of said outer flow channel, the downstream end of said inner flow channel terminating within said nozzle at a point upstream of and spaced from said common discharge port, (3) an internal filler port in said injection housing laterally arranged with respect to said nozzle for inserting additional components into the injection device and through said housing discharge port, as desired, (4) a breaker cone supportably secured to said injection housing and positioned downstream of said nozzle, the apex of said cone being directed at the common discharge port, (5) ducting and support means feedably secured to said nozzle for feeding fiber and viscous composition to said injection nozzle, and supporting said injection device for discharging premix into said receptacle; and (C) metering and feeding means comprised of means for separately supplying viscous composition, fiber, and additional components in flowable condition through said ducting and support means;

whereby viscous composition delivered through said ducting and support means from a feeding means, is directed inwardly and downstream by said truncated extension of said outer flow channel to form an essentially hollow cone-shaped flow pattern upstream of said breaker cone; and said fiber component delivered through said ducting and support means from said metering and feeding means through said inner flow channel, is directed downstream through said common discharge port to impinge upon the viscous composition forming an inside wall of said hollow cone-shaped flow pattern to wet and encapsulate the fiber component and impinging at least in part onto said breaker cone prior to discharge through said housing discharge port.

2. The system of claim 1 wherein the injection device is positioned for discharge within the receptacle and supported external thereto.

3. The system of claim 1 wherein viscous composition comprises asphalt and the receptacle is a rotatable drum equipped with agitating and heating means.

4. The system of claim 1 wherein air is used as a vehicle for the fiber is a movable belt or rotatable auger in feedable combination with a blower and an exhaust feed duct.

5. The system of claim 3 wherein the drum is axially rotatable.

6. The system of claim 1 wherein the outer flow channel and said common discharge port are of sufficient size to handle polymer-, prepolymer- and asphalt-containing components.

7. The system of claim 1 wherein the truncated extension of the outer wall of said outer flow channel comprises a hollow trumcated cone internally threadably secured to the downstream external end of said injection nozzle.

8. An injection device for preparing premix comprised of a viscous composition and fiber component comprising, in combination, (1) an injection housing having a feeder nozzle port at one end and a housing discharge port at the opposite end, (2) an injection nozzle mounted in said feeder nozzle port, said nozzle having an outer flow channel and an inner flow channel concentrically arranged, and having a common downstream discharge port externally defined by a truncated extension of an outer wal of said outer flow channel, the downstream end of said inner flow channel terminating within said nozzle at a point upstream of and spaced from said common downstream discharge port, (3) an internal filler port in said injection housing laterally arranged with respect to said nozzle for inserting additional components into the injection device and through said housing discharge port, as desired, (4) a breaker cone supportably secured to said injection housing and positioned downstream of said nozzle, the apex of said cone being direct at the common discharge port, (5) ducting and support means feedably secured to said nozzle for feeding fiber and viscous extrudable composition to said nozzle and through said outer and inner jet ports; and whereby viscous composition flowing through said outer flow channel is directed inwardly and downstream by said trumcated extension of said outer flow channel, forming a hollow cone-shaped flow pattern upstream of said breaker cone; and said fiber component flowing through said inner flow channel is directed downstream through said common discharge port to impinge upon viscous composition forming the inside wall of said hollow cone-shaped flow pattern, thereby wetting and encapsulating the fiber component and impinging at least in part onto said breaker cone prior to discharge of resulting premix through said housing discharge port.

9. The injection device of claim 8 wherein the outer jet port is of sufficient diameter to handle polymeric and asphalt-based components.

10. The injection device of claim 8 wherein the truncated extension of the external wall of said outer flow channel comprises a hollow truncated cone internally threadably secured to the downstream external end of said injection nozzle.

11. A method for uniformly admixing staple fiber and additives, as desired, into a viscous composition, comprising feeding staple fiber and composition componets in separate, generally-concentric flow patterns within the injection device defined in claim 8, whereby the viscous composition is externally arranged with respect to said fiber, and discharged as a hollow cone-shaped flow pattern, the internal surface of said cone-shaped flow pattern being contacted by the fiber component, the impingement of the flow patterns being sufficient to maximize fiber contact with composition of said internal surface of said hollow cone shaped flow pattern.

12. The method of claim 11 in which the exit velocity of fiber-entrained vehicle is between about 3500 fpm–9000 fpm and the asphalt composition is circulated at about 20–150 gal/minute.

13. The method of claim 11 in which fine aggregate is combined with the composition before adding fiber thereto.

14. The method of claim 11 in which mineral filler is separately added to the composition.

15. The method of claim 11 wherein the fiber is at least one member selected from the group consisting of polypropylene, polyester, nylon, fiber glass and carbon filaments.

16. The method of claim 11 wherein the fiber is straight cut uncrimped fiber.

17. The method of claim 12 wherein the fiber has a dpf of about 2–7,500 and a length of about 0.2″–5.0″.

18. The method of claim 14 in which mineral filler is introduced upstream of the point of introduction of vehicle entrained fiber.

19. The method of claim 1 wherein the viscous material comprises extrudible polymeric material.

20. The method of claim 15 wherein the viscous material comprises extrudible polymeric material.

* * * * *

UNITED STATES PATENT AND TRADEMARK OFFICE

CERTIFICATE OF CORRECTION

PATENT NO. : 4,662,759

DATED : May 5, 1987

INVENTOR(S) : LEIBEE & MODRAK

It is certified that error appears in the above-identified patent and that said Letters Patent is hereby corrected as shown below:

Column 3, Line 40;

"(a0" should read --(a)--

Column 7, Claim 8 - Line 30;

"wal" should read --wall--.

Column 8, Claim 19 - Line 49;

"claim 1" should read --claim 11--.

Signed and Sealed this

Tenth Day of November, 1987

*Attest:*

DONALD J. QUIGG

*Attesting Officer*

*Commissioner of Patents and Trademarks*